US005457938A

United States Patent [19]

Butterfield et al.

[11] Patent Number: 5,457,938

[45] Date of Patent: Oct. 17, 1995

[54] METHOD OF PACKAGING AND TRANSPORTING PHOTOGRAPHIC PRODUCTS

[75] Inventors: Stephen H. Butterfield, Rochester; Fred W. Muhleman, Webster; Donald S. Taylor, Rochester, all of N.Y.

[73] Assignee: Eastman Kodak Company, Rochester, N.Y.

[21] Appl. No.: 149,262

[22] Filed: Nov. 9, 1993

Related U.S. Application Data

[62] Division of Ser. No. 5,687, Jan. 19, 1993, Pat. No. 5,297, 680.

[51] Int. Cl.[6] ..... B65B 13/02; B65B 35/50; B65B 53/00

[52] U.S. Cl. ..... 53/399; 53/441; 53/445; 53/447; 53/449; 53/492

[58] Field of Search ..... 414/412; 53/399, 53/441, 445, 447, 449, 459, 492, 381.1, 381.2, 410, 415

[56] References Cited

U.S. PATENT DOCUMENTS

| | | | |
|---|---|---|---|
| 2,607,475 | 8/1952 | Budd | 206/46 |
| 2,806,594 | 9/1957 | Muller et al. | 206/65 |
| 3,014,581 | 12/1961 | Storck | 206/65 |
| 3,204,385 | 9/1965 | De Remer et al. | 53/449 X |
| 3,429,095 | 2/1969 | Huson | 53/399 |
| 3,495,375 | 2/1970 | Burhop et al. | 53/33 |
| 3,670,880 | 6/1972 | Burleson et al. | 53/449 X |
| 4,119,263 | 10/1978 | Cuthbertson et al. | 414/412 X |
| 4,244,471 | 1/1981 | Plante | 53/399 X |
| 4,311,239 | 1/1982 | Schlicker | 206/597 |
| 4,480,748 | 11/1984 | Wind | 206/386 |
| 4,516,677 | 5/1985 | Rowland et al. | 206/394 |
| 4,580,680 | 4/1986 | Wind | 206/386 |
| 4,760,915 | 8/1988 | Boets et al. | 206/303 |
| 5,163,556 | 11/1992 | Akao et al. | 206/394 |
| 5,282,346 | 2/1994 | Masuda et al. | 53/492 X |
| 5,321,931 | 6/1994 | Bluteau | 53/447 X |

FOREIGN PATENT DOCUMENTS

| | | | |
|---|---|---|---|
| 291-300A | 6/1991 | Germany | 206/499 |
| 404209977 | 7/1992 | Japan | 53/445 |

*Primary Examiner*—Linda Johnson
*Attorney, Agent, or Firm*—Charles E. Snee, III

[57] ABSTRACT

A package system 10 containing a plurality of articles of manufacture comprises, a pallet 12, and a photographic product handling device releasably attached to the pallet 12. The photographic product handling device 13 comprises first and second platform assemblies 14, 22 having on one side positioning means formed thereon for facilitating stacking and resisting motion of the product contained therein. The opposite side of platform assembly 22 comprises at least one pair of spaced runners for conveniently stacking one package system 10 atop the other in an interlocking relationship. The sensitive photographic product 20 are encased in a foldable enclosure 18 defining an interior space, each end having releasably mounted thereon a platform assembly 14, 22 thereby forming a closed ended enclosure. Straps 24 are wrapped circumferentially around the closed ended enclosure 18 and the enclosure and pallet 12 are then wrapped with a stretchable material layer 30 to resist ambient contamination. The stretch wrapped material layer 30 is encircled with straps 24 to restrict motion of the package during transport.

5 Claims, 14 Drawing Sheets

METHOD OF PACKAGING AND TRANSPORTING PHOTOGRAPHIC PRODUCTS

CROSS REFERENCE TO RELATED APPLICATION

This application is a division of Ser. No. 005,687, filed 19 Jan. 1993, now U.S. Pat. No. 5,297,680.

FIELD OF THE INVENTION

This invention relates to packaging systems, and more particularly, to a returnable/reusable packaging system and method for transporting sensitive photographic product into a substantially contamination free environment.

BACKGROUND OF THE INVENTION

The use of pallets for handling product by means of fork lifts or other mechanical handling devices is well-known. Typically, pallet configurations are rectangular in shape and offer access to transportation of the product along with the pallet. The product is usually secured to the pallet by the product's own weight or by means of strapping the product to the pallet.

The package components, such as containers and straps, are taken off of the pallet leaving only the bottom corrugated tray and the product wrapped typically in laminated bags. The customer typically off-loads the product from the pallet on to a conventional product handling device. Currently the method for loading the product from the pallet to the handling device is a labor intensive manual handling method that costs the customer time and money. Product handling device generally refers to a metal handling structure which supports the product and acts as a supplementary pallet. The product handling device is then transported into the reproduction clean room with vertically stacked sensitive photographic product wrapped typically in laminated bags. The product is then unwrapped one at a time and used to create copies of the original. Sensitive photographic product, such as photographic film, is used by the photographic process printers for the reproduction of photographic negatives. The reproduction of the original is produced in a clean room environment and dirt contamination from the outside environment is not conducive to this operation. For instance, one source of dust particles affecting sensitive product is the paper corrugated containers generally used with prior art packaging systems. Moreover, dirt on the sensitive photographic product is projected to large masses onto the samples. Therefore, because of the clean reproduction environment, the pallet having particulates, such as dirt and other deleterious matter, may not enter the print room. Furthermore, prior art packages for transporting sensitive photographic products are not reusable and are generally quite labor intensive to open. This nonreuseability feature of prior art packaging systems causes more waste to be deposited into the waste stream.

One attempt to solve the aforementioned problem described in U.S. Pat. No. 4,760,915 to Boets et al teaches a pallet system having a light tight package. However, obvious shortcomings of the Boets package are that it does not have a means which would enable it to be transported into a clean room environment and it is not returnable and reusable.

Accordingly, a need exists for an easy to manufacture, simple design and economical, reusable package system and, a method for transporting sensitive photographic product into a substantially contamination free environment.

SUMMARY OF THE INVENTION

It is, therefore, the object of the invention to overcome the problems in the prior art. Accordingly, for solving these and other problems, there is provided a package system comprising a plurality of stacked articles of manufacture, the package system comprising:

a) a carrying means;

b) an article handling device mounted to the carrying means, the article handling device comprising:

first and second platform assemblies, each of the platform assemblies comprising a support surface having front and back sides, and wherein the front side having formed therein means for positioning top and bottom articles of the stack, and the back side of the support surface comprises at least one pair of spaced apart runners attached thereto, the runners adapted for cooperatively stacking a plurality of package systems one atop the other;

an enclosure defining an interior space for encasing the stacked articles, the enclosure having upstanding sidewalls having top and bottom end edges, wherein at least a portion of the end edges projecting outwardly therefrom, and wherein the positioning means of the first platform assembly being directed upwardly into the interior space, the enclosure further being releasably mounted at the top end edge to the second platform assembly, the positioning means of the second platform assembly being directed downwardly into the interior space, whereby the positioning means of the first and second platform assemblies engage the bottom and top ones, respectively, of the stack of articles within the interior space so as to facilitate stacking and resist motion of the articles;

c) a first means for engagably urging each of the first platform assembly, said article handling device and said second platform assembly into a relatively compressed relations thereby securing the articles from random movement, and wherein the compressed relations further defines a unitized package arrangement;

d) a second means for engagably urging the unitized package arrangement into a relatively compressly secure relations with the carrying means thereby restricting motion of the unitized package arrangement during storage and transport, and e) a stretchable material layer enclosingly wrapped circumferentially around the carrying means and the unitized package arrangement to protect the articles from contamination.

Moreover, another solution to the above problem can be achieved by the method for transporting sensitive photographic product into a substantially contamination free environment, the method comprising:

providing a package system described above:

vertically stacking the photographic product onto the positioning means formed in the first platform assembly;

encasing the stacked photographic product in the foldable open ended enclosure exposing the top end edge of the enclosure;

releasably mounting the second platform assembly onto the exposed top end edge of the open ended enclosure, the positioning means formed in the second platform assembly facing downwardly into the open ended enclosure and communicating with the photographic product thereby forming a closed ended package;

surroundingly strapping the first platform assembly upwardly around the closed ended package thereby forming an unitized package;

upwardly surroundingly strapping the carrying means to the unitized package arrangement;

circumferentially stretch wrapping the unitized package and the carrying means;

transporting the unitized package to a conveyance means cooperating with a substantially contamination free environment;

breaking the second strap from the unitized package;

removing the stretch wrap layer from the unitized and the carrying means thereby enabling the unitized package to be released from the carrying means;

releasing the sensitive photographic product handling device from the carrying means for conveyance of the sensitive photographic product into a substantially contamination free environment; and returning the carrying means to storage.

BRIEF DESCRIPTION OF THE DRAWINGS

The foregoing as well as other objects, features and advantages of this invention will become more apparent from the appended Figures, wherein like reference numerals denote like elements, and wherein.

DETAILED DESCRIPTION OF THE INVENTION

Figure 1:
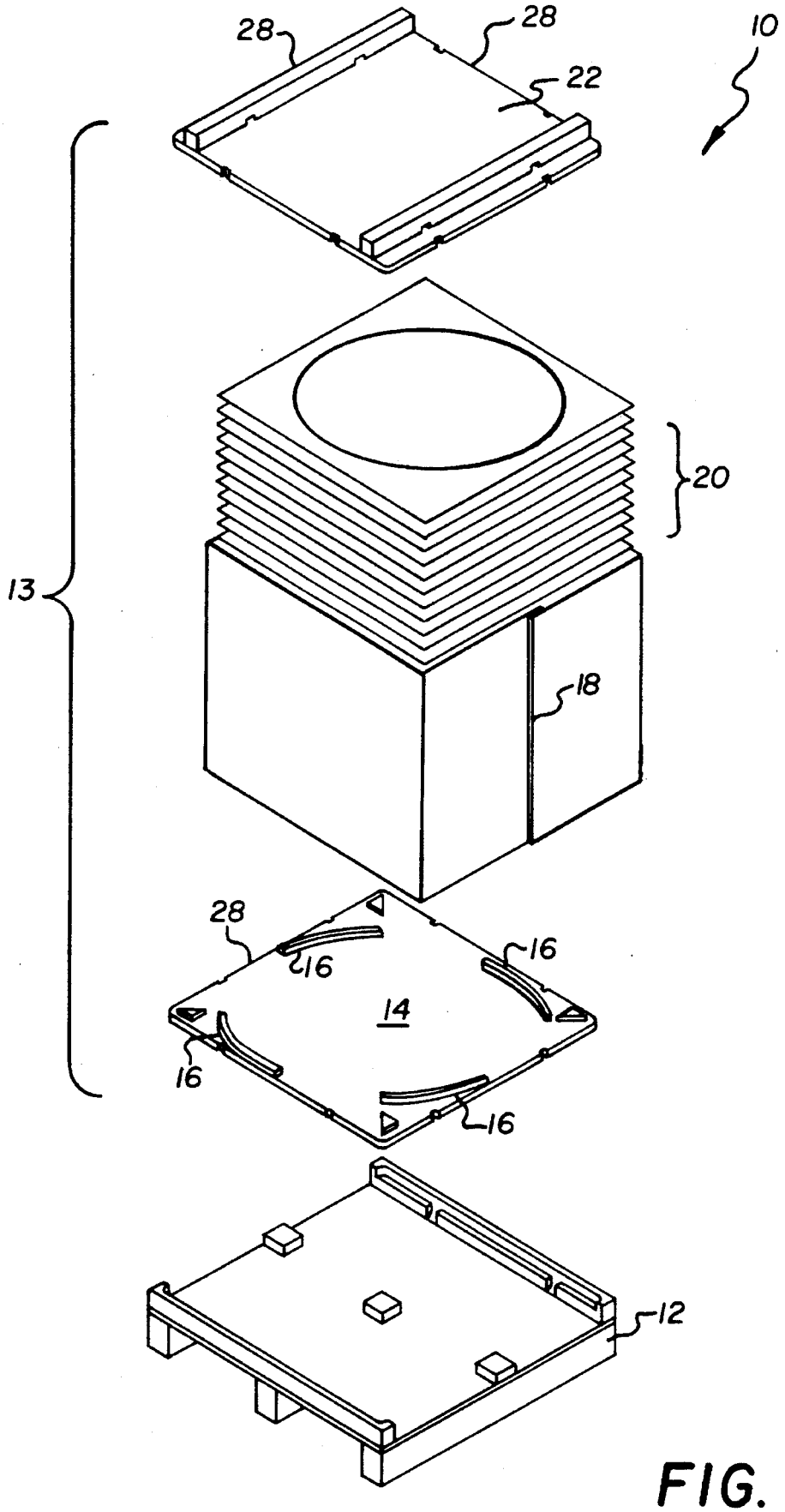
FIG. 1 is an exploded view of the package according to the principles of the invention.
Figure 2:
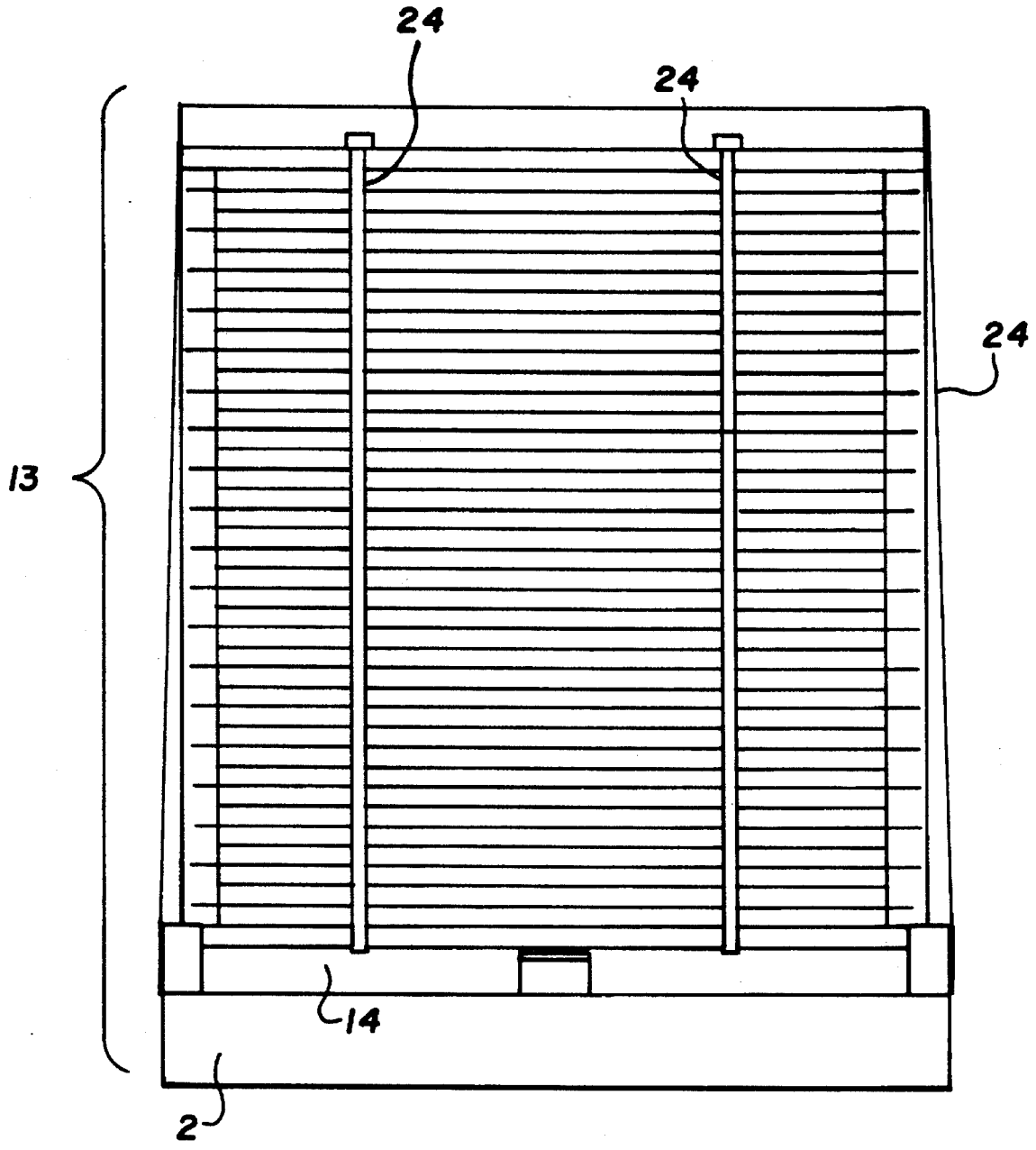
FIG. 2 is an elevated side view of the assembled package system.
Figure 3A:
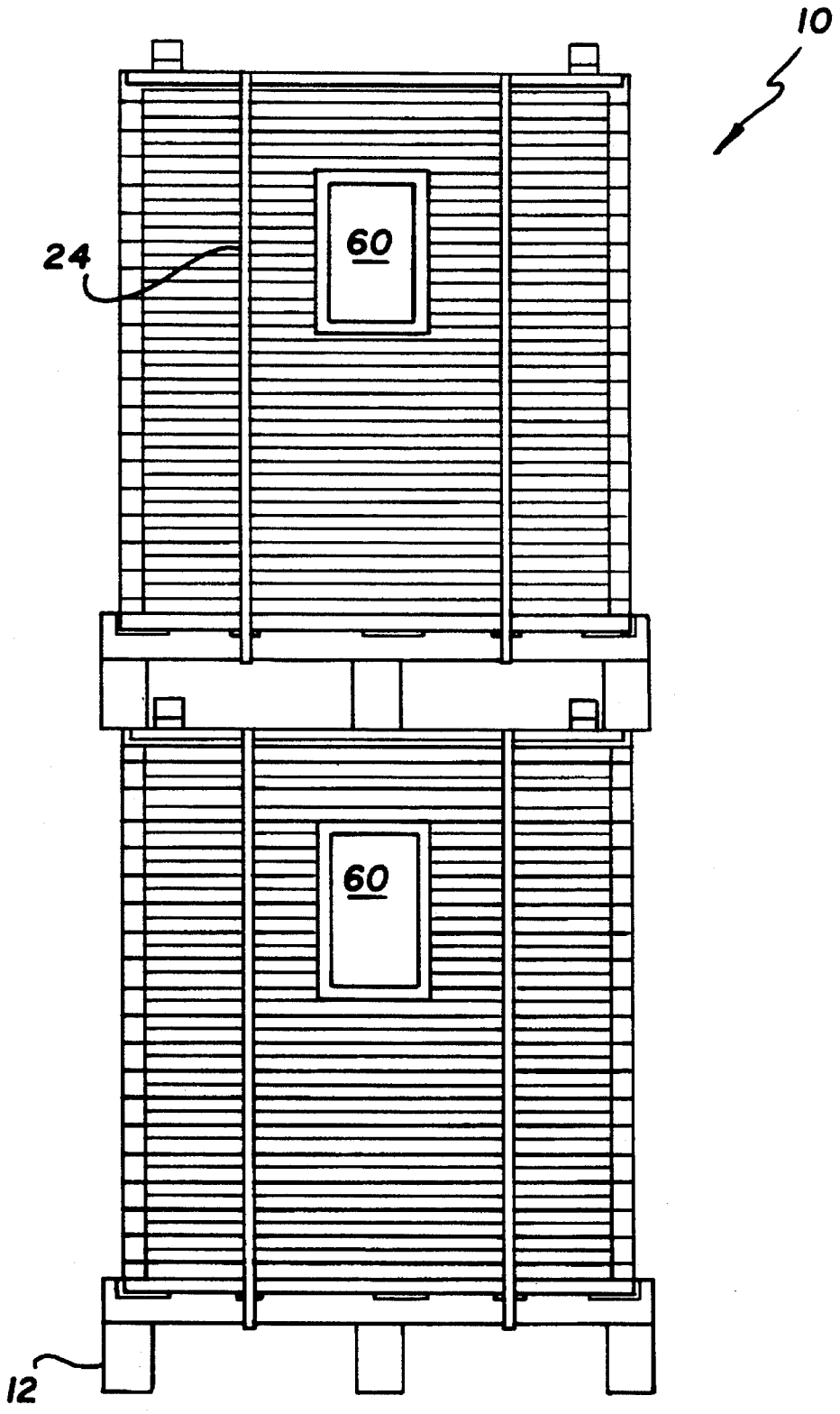
FIG. 3*a* is an elevated front side view of assembled package systems of the invention in a stacked relationship.
Figure 3B:
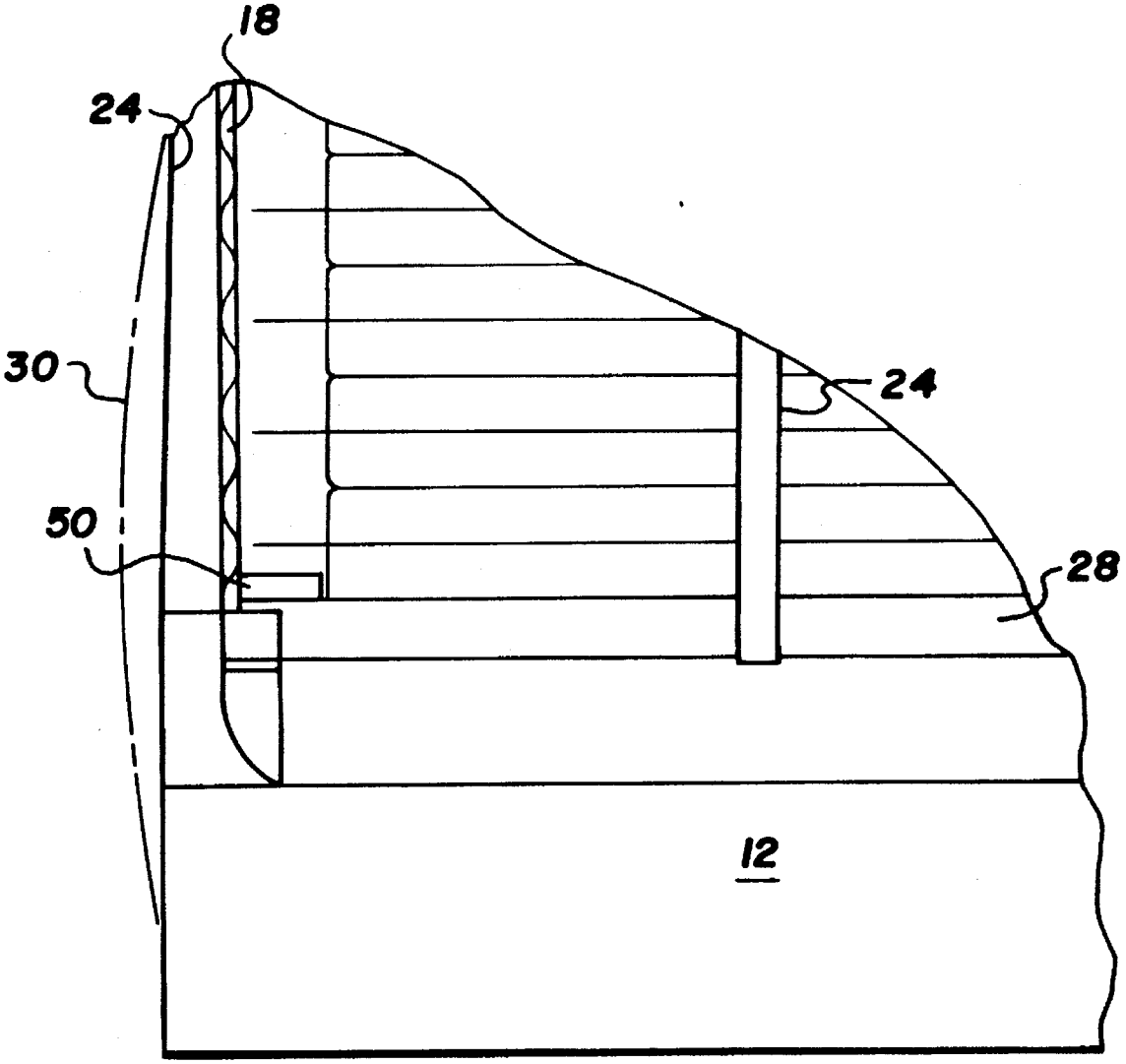
FIG. 3*b* is a fragmentary perspective view of an alternative means of forming the compression package of the invention.

Turning now to the drawings, and more particularly to FIGS. 1–3*a,b*, there is shown the package system 10 of the invention comprising carrying means, such as pallet 12, an article or product handling device 13 comprising a first platform assembly 14 having formed thereon a product positioning means comprising a plurality of raised radial portions 16, a foldable enclosure 18 encasing a plurality of stacked product 20, and a second platform assembly 22 having a substantially identical product positioning means. A compression package (FIG. 2) is formed when enclosure 18 containing stacked product 20 is secured by a plurality of straps 24 wrapped around first and second platform assemblies 14,22 and, a plurality of similar bands or straps 24 wrapped around product handling device 13 and pallet 12, as shown clearly in FIGS. 2 & 3*a*. This compression package can be formed by other means, for instance, by engagably urging the product handling device 13 and each platform assembly 14,22 into a relatively compressed relations with clamping means, not illustrated, on the edges 28 of first and second platform assemblies 14,22 and enclosure 18, as shown in FIG. 3*b*. The entire pallet 12 is then wrapped in a stretchable material layer 30 to aid in minimizing dirt and other deleterious environmental contaminants. While practically any stretchable material within the definition of the invention may be used, the inventors prefer Mobil Brand Stretch Wrap® material layer 30 made by Mobil Chemical Co. of Macedon, N.Y.

Figure 4:
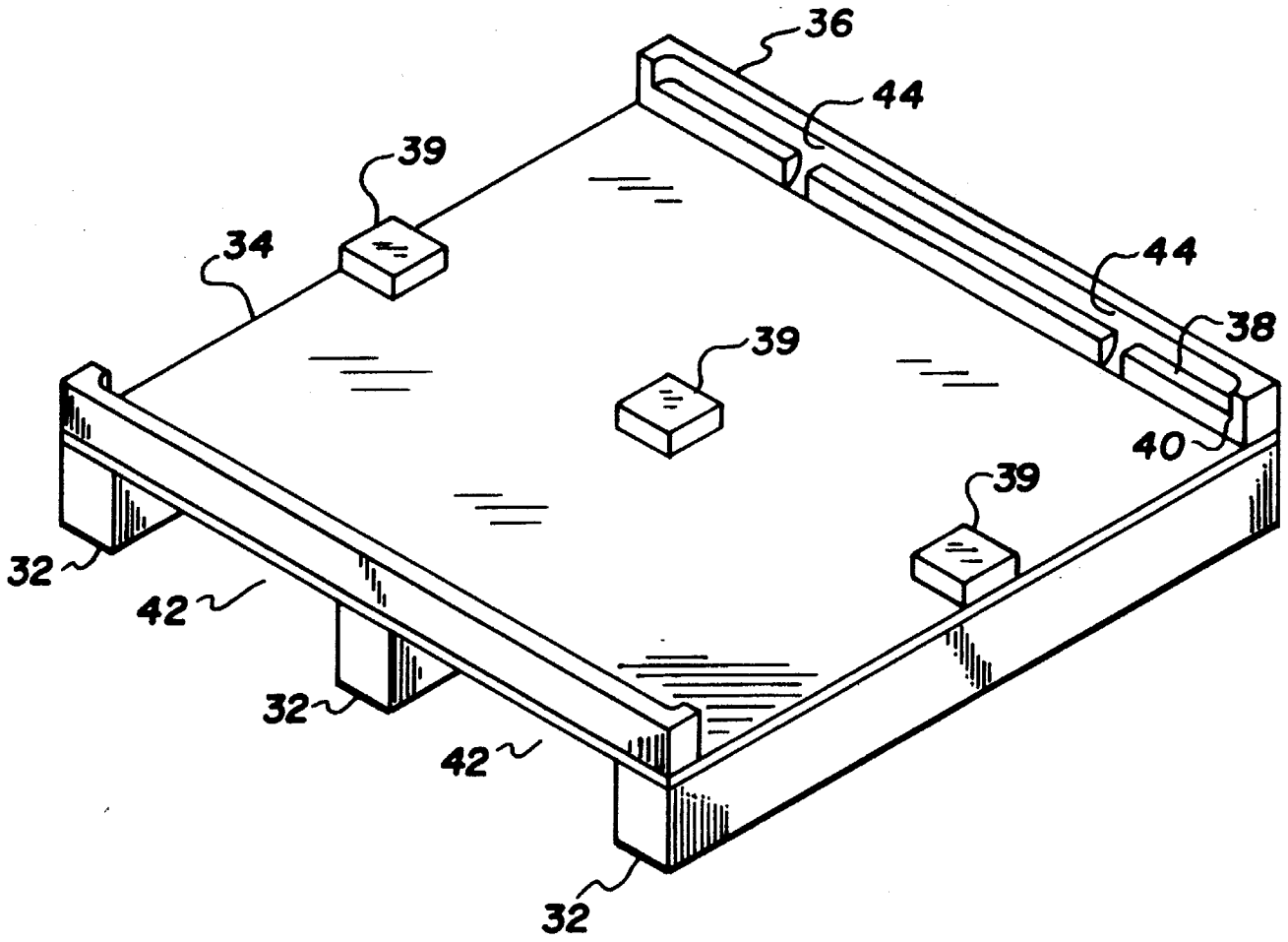
FIG. 4 is a perspective view of the shipping pallet.
Figure 5:
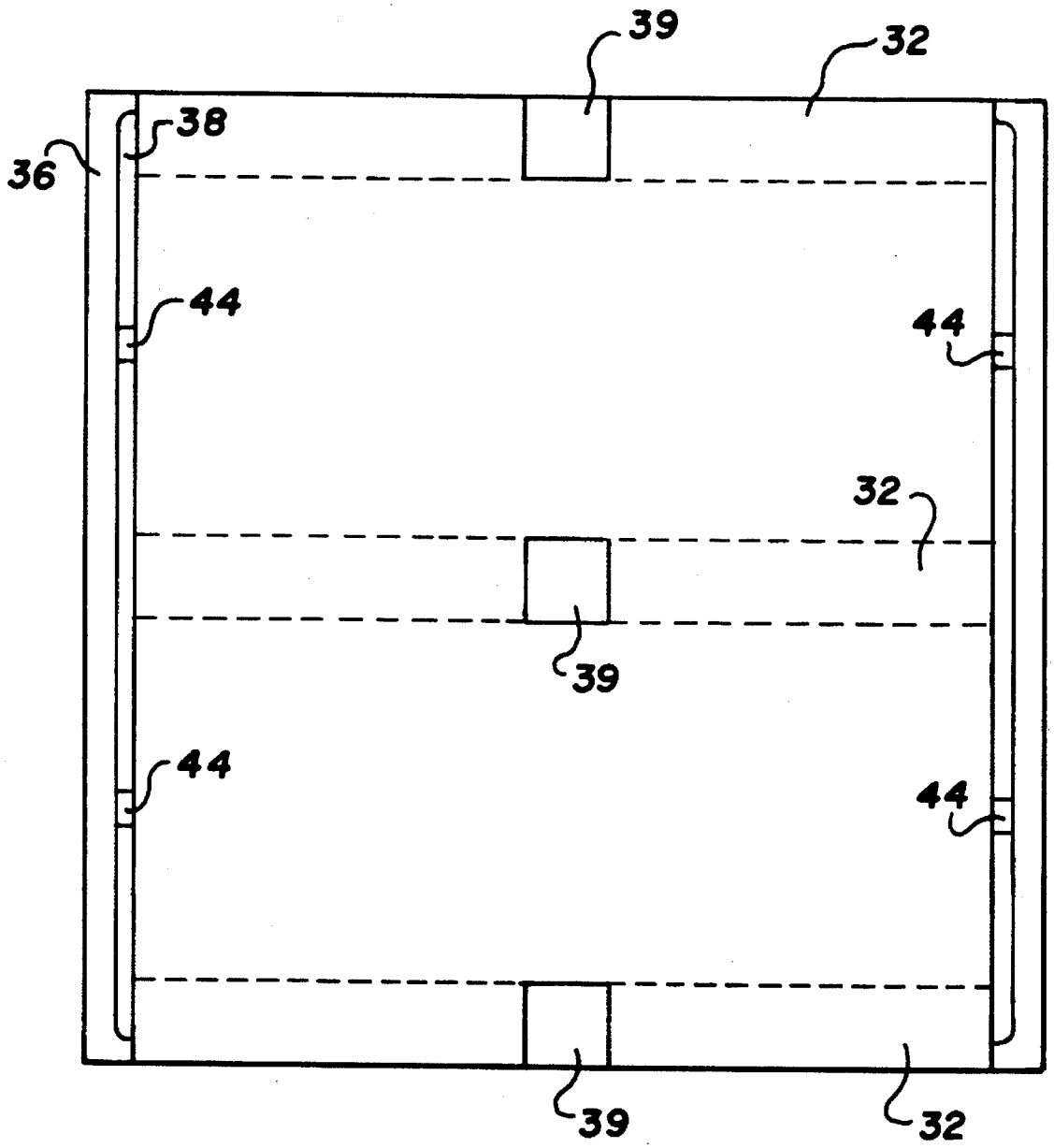
FIG. 5 is a top view of the pallet.
Figure 7:
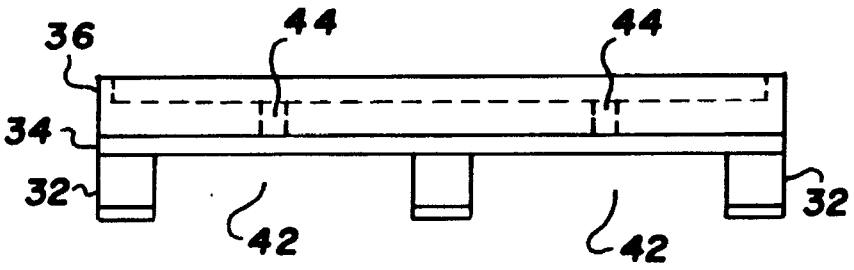
FIG. 7 is a side view of the pallet.
Figure 6:
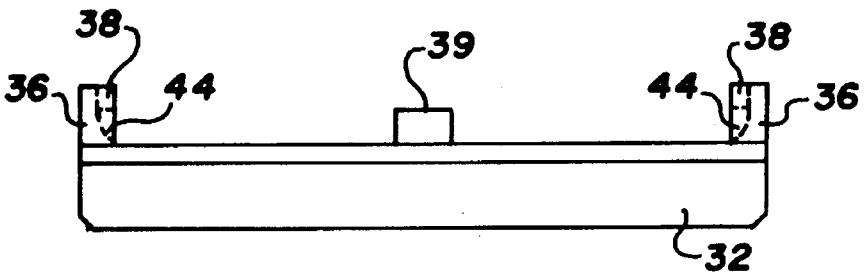
FIG. 6 is elevated front view of the pallet.
Figure 8:
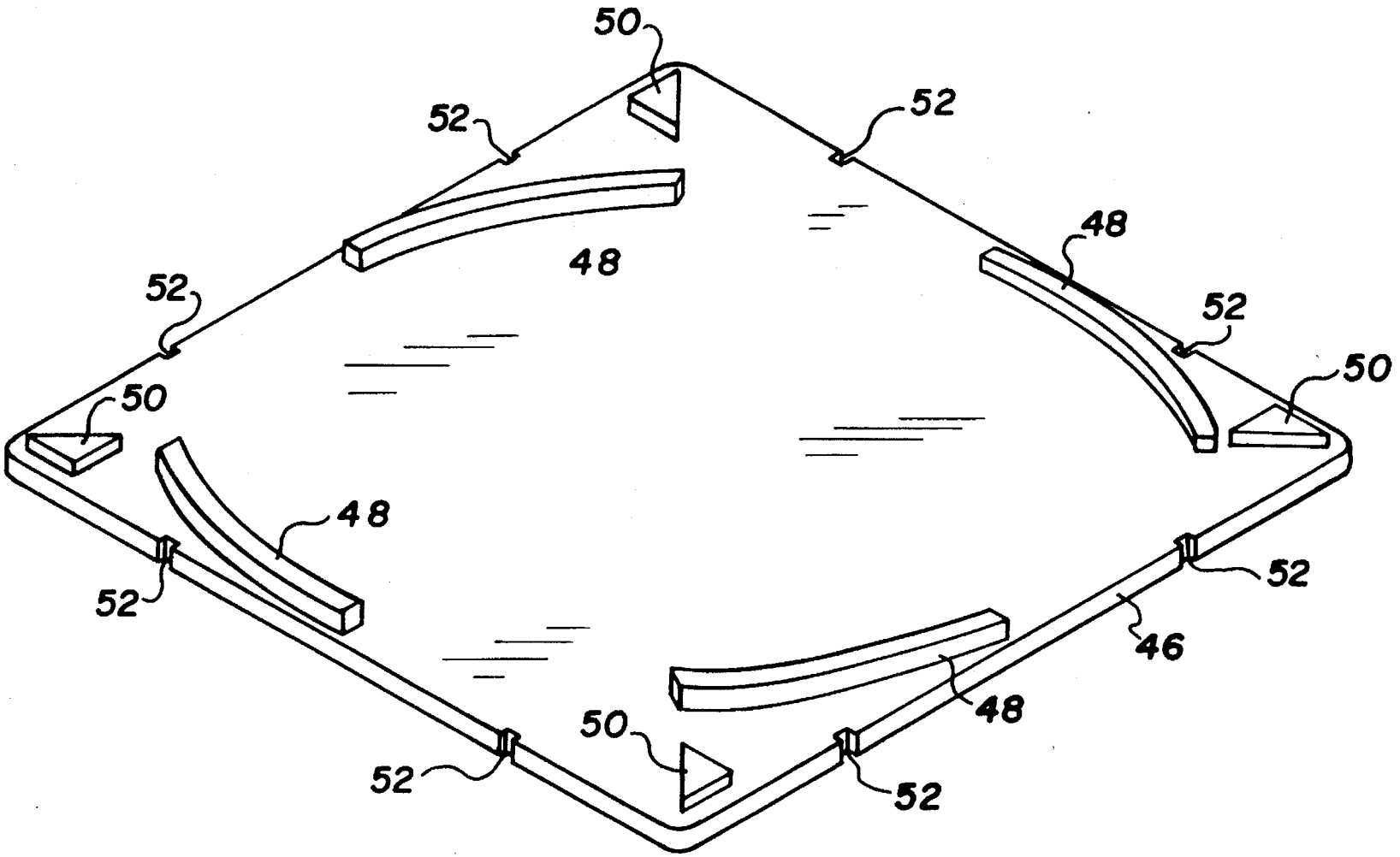
FIG. 8 is an perspective view of the platform assembly with positioning means of the invention.
Figure 9:
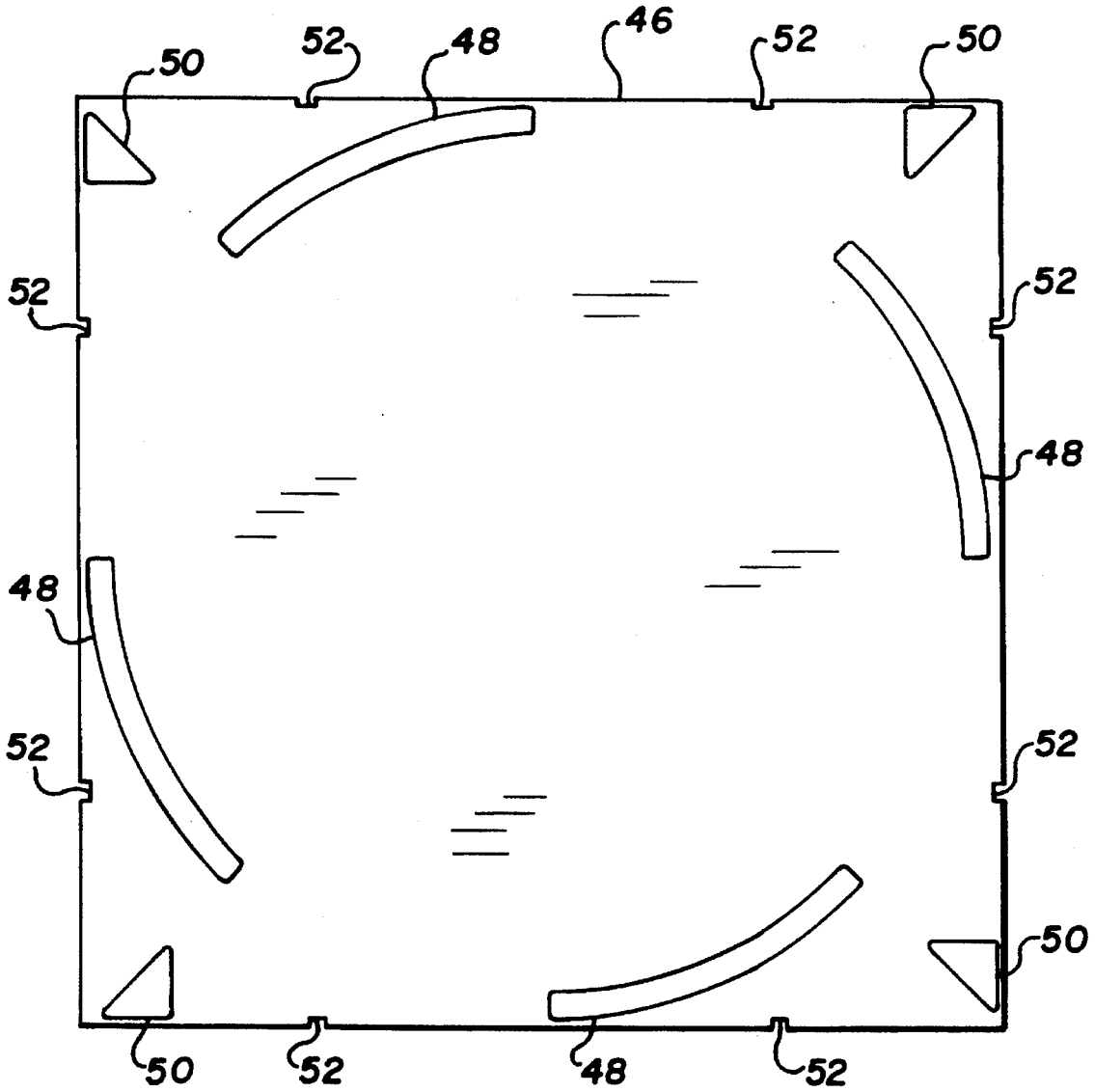
FIG. 9 is a top view of the platform assembly.
Figure 10:
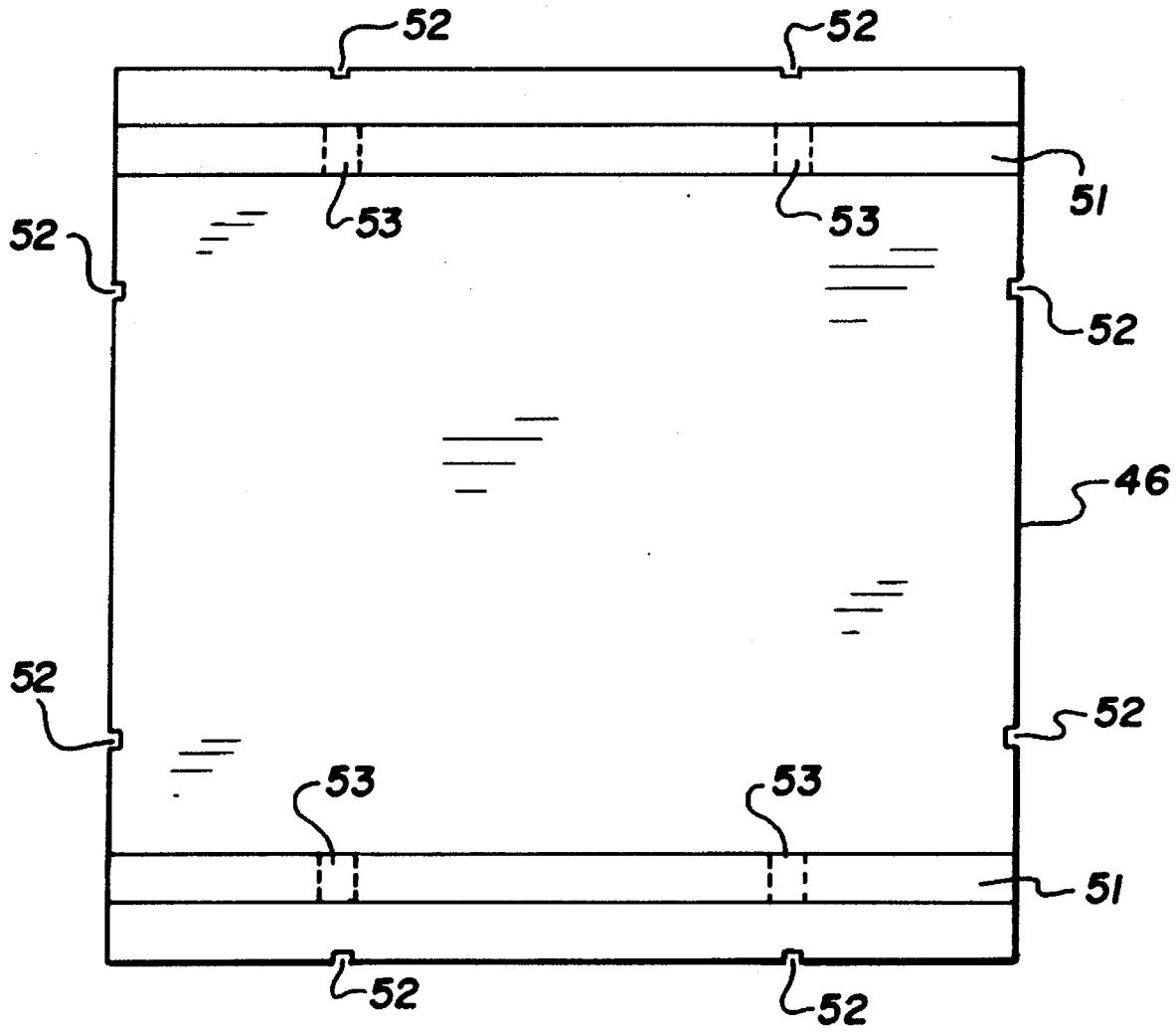
FIG. 10 is a perspective view of the opposite side of the platform assembly of the invention.
Figure 11:
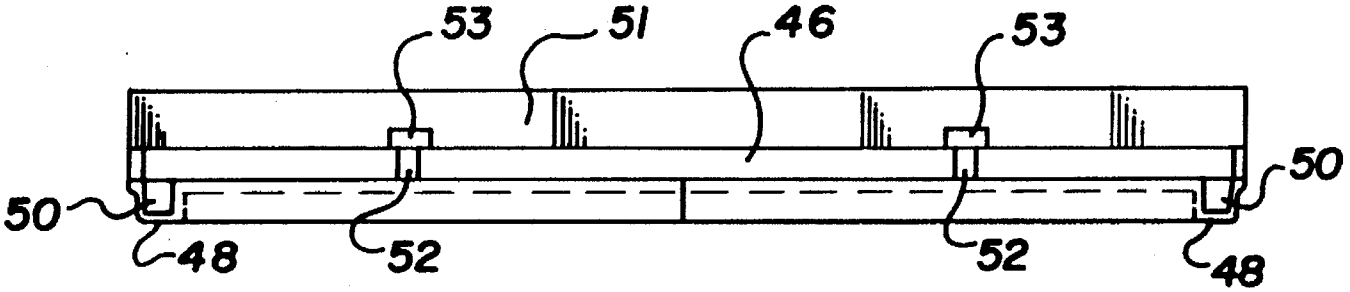
FIG. 11 is a top view of the platform assembly of FIG. 10.
Figure 12:
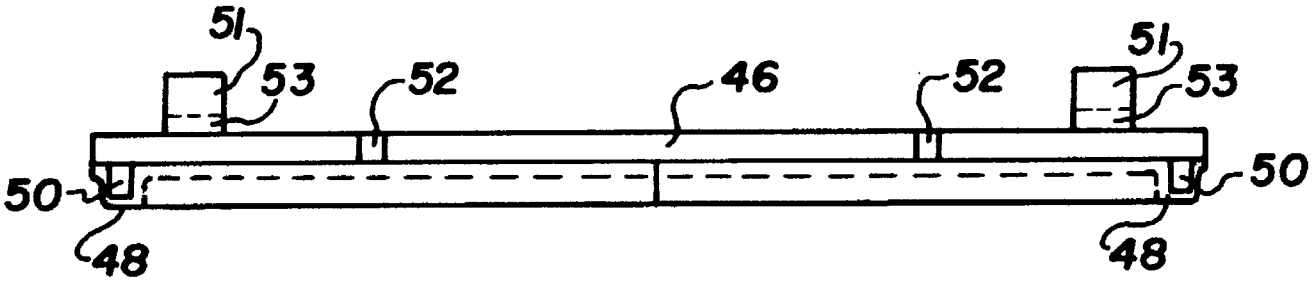
FIG. 12 is a front view of the platform assembly of FIG. 10.
Figure 13:
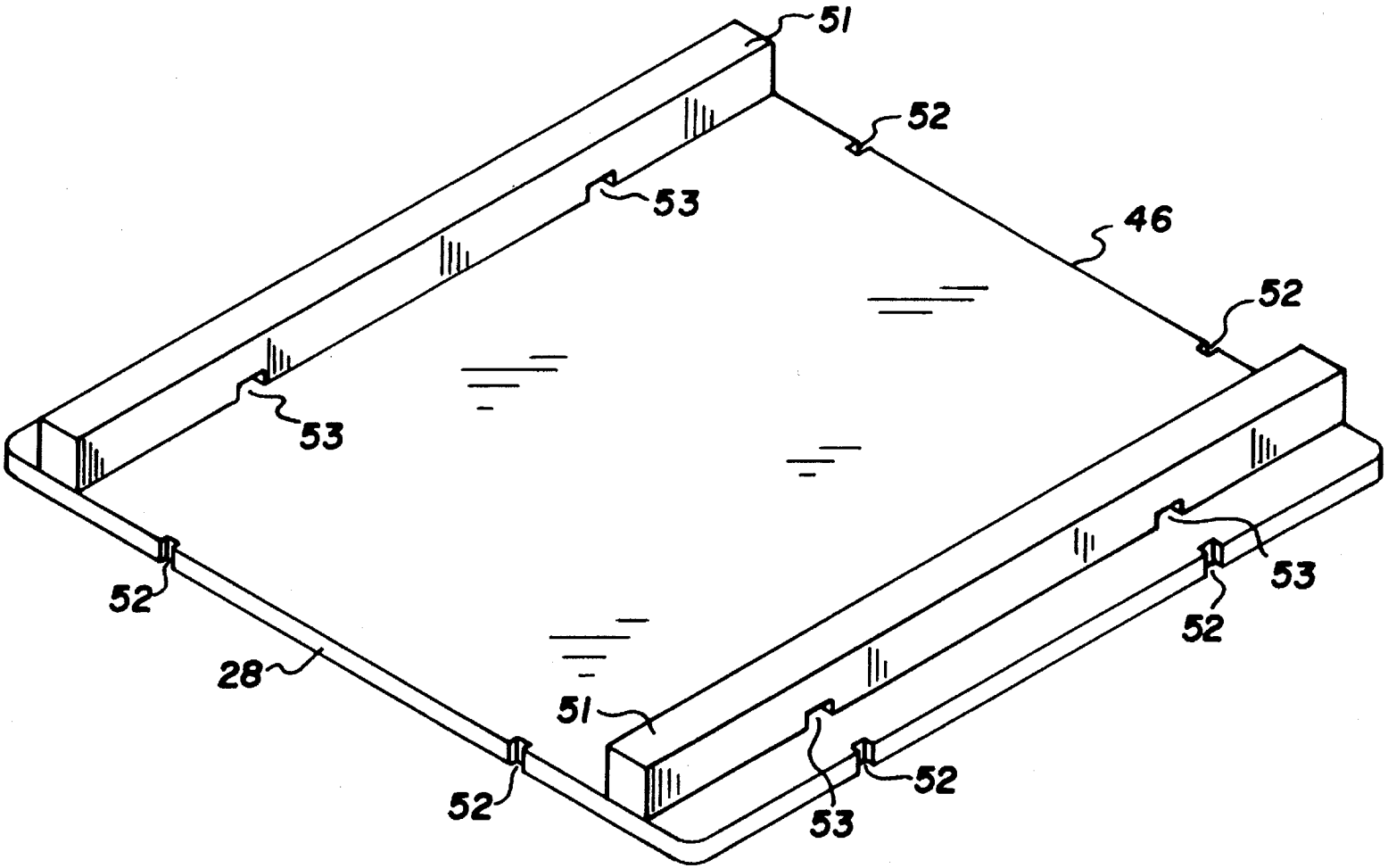
FIG. 13 is a side view of the platform assembly of FIG. 10.

Referring now to FIGS. 4–7, shown is the preferred carrying means of the invention. Carrying means or pallet 12 comprises a plurality of spaced support members 32 defining feet, a base 34 attached to each of the support members 32 and runners or end support members 36 structurally connected to opposite sides of base 34 from the feet. End support members 36 each comprises upwardly open channels 38 formed in a top portion 40 thereof for releasably receiving product handling device 13, as shown clearly in FIG. 4. Moreover, in an alternative embodiment substantially centered support member 39 are fixed to base 34 for supporting stacked product 20 on the pallet 12. Further, pallet 12 comprises at least one entry port 42, preferably two, defined by the spaced apart support members 32 for communicating with a fork lift or similar lifting and moving device. Upwardly open channels 38 on each end support member 36 has at least one through opening 44 for receiving the strapping 24 during packaging and for extraction of the strapping 24 without breaking down package 10, as shown in FIGS. 4, 5 & 6.

Referring to FIGS. 8–13, the preferred platform assembly 14,22 of the invention has on one side of support surface 46 positioning means formed in support surface 46 for communicating with the top and bottom articles in the stack 20. According to the inventors, upwardly extending radial portions 48 formed on support surface 46 comprise the preferred positioning means. Radial portions 48 are preferably stapled to support surface 46. Radial portions 48 are designed so as to communicate with the top and bottom product 20 in the stack. This is important, for example, because sensitive photographic product is typically loaded and unloaded in a dark room environment and positioning means ensure even product weight distribution on the pallet thereby preventing accidental tipovers. The package system 10 is such that the operator when breaking down package 10 for return, can maneuver radial portions 48 in second platform assembly 22 into rotatable 90, 180, 270, or 360 degrees locking engagement with radial portions 48 in first platform assembly 14 so they can securely nest together. While platform assemblies 14, 22 may be fabricated from practically any materials, radial portions 48 made of plastic and a support surface 46 made of a cellulosic material, for example wood, are preferred by the inventors. In the preferred embodiment of the package, a plurality of cooperating raised alignment guides 50 formed in the support surface 46 align and stabilize enclosure 18. Alignment guides 50 are positioned substantially near end edges 28 of support surface 46 so as to form a predetermined perimeter for restricting movement of enclosure 18 mounted therearound FIG. 3*b*.

In an alternative embodiment, platform assemblies 14, 22 and their corresponding positioning means comprising outwardly extending radial portions 48 are shown releasably fastened to the support surface 46 by conventional means, such as glue or epoxy. Runners 51 attached to the opposite side of support surface 46 are used to interlock the completed package 10 with another pallet 12 for the purpose of shipping and warehousing stacked pallets 12o Notches 52 on end edges 28 of first and second platform assemblies 14,22 function as alignment guides for straps 24 and to secure product 20 to pallet 12. A plurality of througholes 53 formed in runners 51 are correspondingly aligned with one of notch 52 in end edge 28 so that straps 24 can be fed therethrough and seat flatly on second platform assembly 22. This also gives the person packing product 20 a flat area in which to fasten straps 24, thus giving a tighter compression package.

Figure 14:
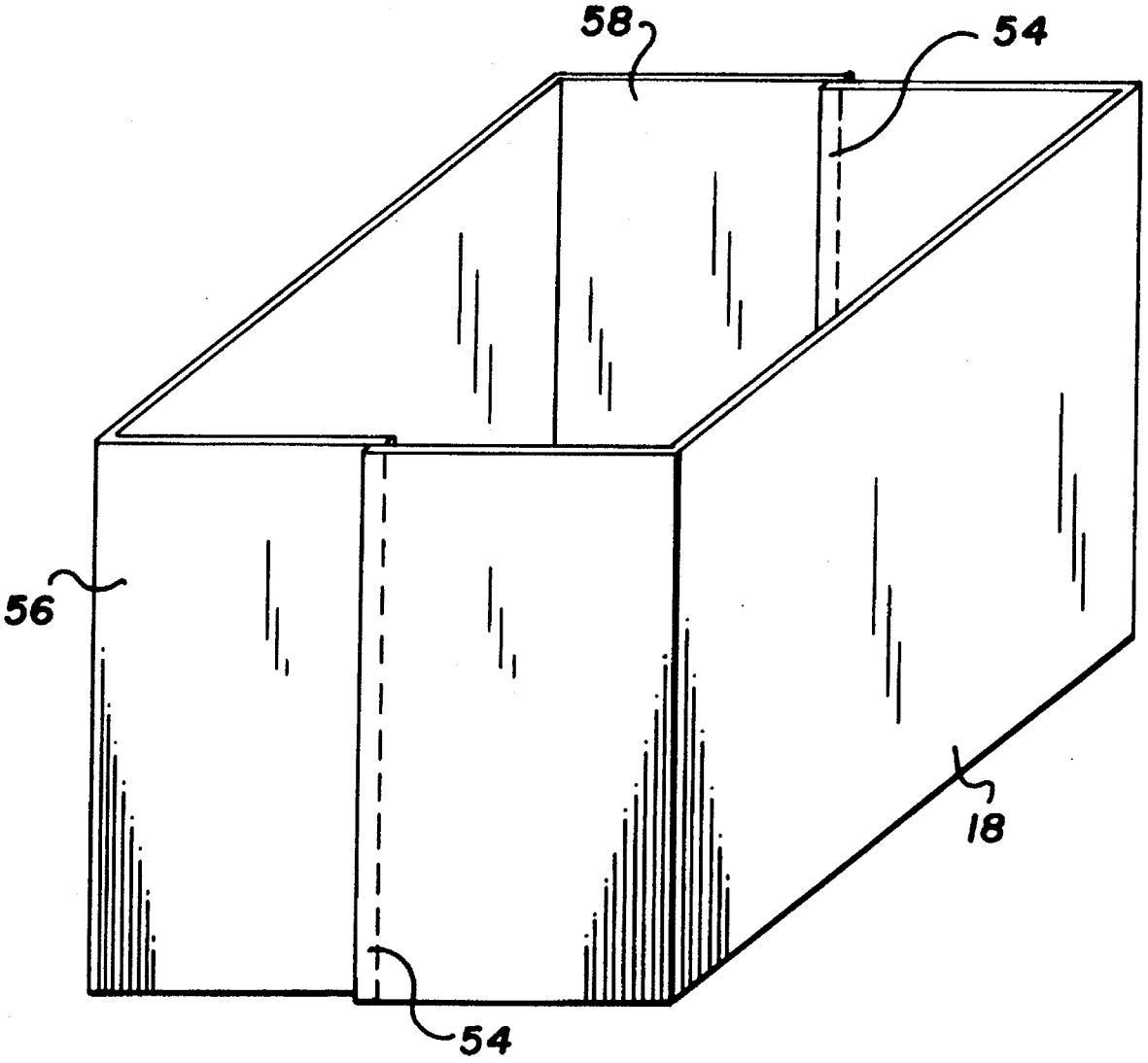
FIG. 14 is a perspective view of the enclosure of the invention.
Figure 15:
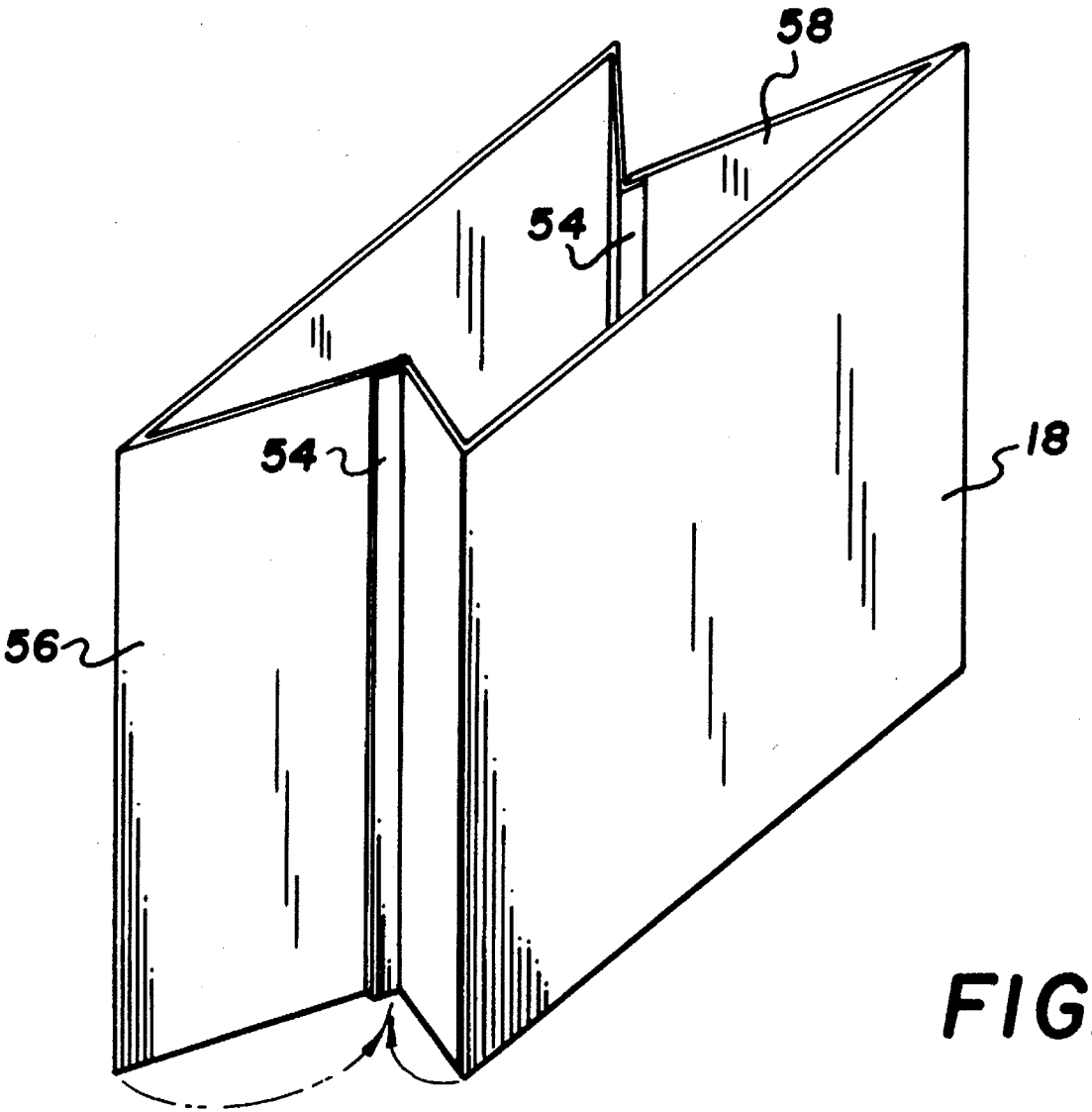
FIG. 15 is a perspective view of a partially folded enclosure of FIG. 14 illustrating the method of breaking it down for shipment back to the supplier.

Turning to FIGS. 14 and 15, an isometric view of the enclosure 18 of the invention is illustrated. Enclosure 18, preferably fabricated from a corrugated material, serves multiple purposes including encasing stacked product 20 and protecting it from contamination and incidental damage. In the latter instance, if a handler accidentally hits the product with a fork truck the corrugated enclosure 18 will crush and alert the handler of possible product damage. Furthermore, corrugated enclosure 18 also makes package 10 more ascetically appealing. Enclosure 18, moreover, has at least one scored portion 54 on opposing sides 56,58 to enable enclosure 18 to be knocked down and to minimize the amount of space needed to return it.

In an alternative embodiment, a product identification pressure sensitive label 60 is placed on enclosure 18 of package 10 preferably in close proximity of pallet entrance port 42 so that the handler can see what it is that is being handled, as shown in FIG. 3. Label 60 will also be visible to the customer in his warehouse for purposes of inventory control and identification.

To remove product from the packaging system 10 of the invention, pallet 12 may be releasably removed from the article or product handling device 13 shown in FIG. 1. In the preferred embodiment, stretch wrap layer 30 is removed from packaging system 10 and the plurality of straps 24 around product handling device 13 and pallet 12 must also be removed. Product handling device 13 can then be removed from pallet 12 by engaging the first platform assembly 14 and lifting it upwardly away from pallet 12. This allows the product handling device 13 to be removed from pallet 12 in the warehouse before transporting the stacked sensitive photographic product, for instance photographic film, to the processing room. Once product handling device 13 reaches its final destination in the clean processing room, the remaining straps 24, which keep the product in a unitized configuration, can be removed. The second platform 22 can then be lifted off the product stack 20 along with the enclosure 18. This leaves the product accessible to the operator for use on his equipment. When all of the product 20 is processed, first platform 14 and second platform 22 can be mated together by interlocking the two support surfaces 46 with each other by means of nesting raised radial portions 48 together. Radial portions 48 are designed to nest as described hereinabove.

The packaging components described above are for the most part fully returnable and reusable so that the customer does not have to pay for disposal of the package components. Therefore, to disassemble package 10 of the invention for return to the supplier, the customer would perform the following steps, substantially in order, including first removing the stretch wrap layer 30 from package 10. Next the customer would remove the plurality of straps 24 around the pallet 12, securing the product handling device 13 to the pallet 12, and lift the product handling device 13 off of the pallet 12. The customer can then place the product handling device 13 on a conveyance system for movement into a substantially clean environment. In the clean environment, the customer would then remove the remaining plurality of straps 24 around the product handling device 13, and remove the second platform 22 from the stacked product 20. The enclosure 18 can then be removed by lifting it over the stack of product 20. To access the product 20, in the preferred embodiment, the customer would remove the product 20 from its protective laminated bag. When all of the product is used, its customer would place the second platform 22 on top of the first platform 14 so that the raised radial portions 48 interlock. This can be accomplished by lining up the end edges 26 on both the first and second platforms 14, 22. Next, the customer would place the two platforms 14, 22 back into the pallet 12, seated on the channels 38 of the end support members 36. This latter arrangement constitutes a returnable package unit. The enclosure 18 may also be collapsed for return by pushing on the opposite sidewalls 56, 58 and bending them at score 54. The flattened enclosures 18 may then be stacked and strapped together on a carrying device for return to the supplier. Several other units may be stacked on atop the other and strapped together for return to the supplier.

Accordingly, an important advantageous effect of the present invention is that the novel package 10 enables the customer to ensure a cleaner environment for the processing of their sensitive photographic product. Additionally, package 10 offers increased product protection from dirt contamination by wrapping the sensitive photographic product in laminated bags, placing a corrugated enclosure 18 around the product 20, eliminating the honeycomb filters, adding positioning means 16 and wrapping a stretchable material layer 30 circumferentially around the entire pallet. Moreover, the novel platform assemblies 14, 22 of the invention enables the customer to load product 20 from the shipping pallet 12 to the transportation product handling device 13 in a unitized package arrangement. Furthermore, another advantage of the present invention is that its use minimizes the amount of handling and time required for handling.

The invention has therefore been described with reference to certain embodiments thereof, but it will be understood that variations and modifications can be effected within the scope of the invention.

What is claimed is:

1. A method for transporting a plurality of stacked, sensitive photographic product into a substantially contamination free environment, said method comprising the following sequence of steps:

a. providing a package system comprising i) a carrying means for storing or transporting the stacked products;

ii) a sensitive photographic product handling device releaseably mounted to said carrying means, said handling device comprising:

a first platform assembly and a second platform assembly, said first platform assembly comprising a first support surface having a first front side and a first back side and a plurality of first side edges, and said second platform assembly comprising a second support surface having a second front side and a second back side and a plurality of second side edges, said first and second front sides each having formed therein means for aligning said products, and wherein opposing side edges of said first and second platform assemblies each has a notch therein, and wherein said back side of said first support surface comprises a pair of spaced apart runners, each of said runners having at least one through hole correspondingly aligned with said notch in said first side edge;

a foldable open ended enclosure for encasing said products, said foldable enclosure comprising a plurality of sidewalls, each sidewall having a top end edge and a bottom end edge, and wherein said foldable enclosure is releaseably mounted at said bottom end edge to said first platform assembly, said means for aligning of said first platform assembly being directed upwardly into said enclosure and at said top end edge to said second platform assembly, said means for aligning of said second platform assembly being directed downwardly into said enclosure, whereby said means for aligning in said first and second platform assemblies cooperatively communicate with said products in said enclosure so as to facilitate stacking and resist motion of said products;

b. vertically stacking said photographic product onto said means for aligning formed in said first platform assembly;

c. encasing said stacked photographic product in said foldable open ended enclosure exposing said top end edge of said enclosure;

d. releaseably mounting said second platform assembly onto the exposed top end edge of said open ended enclosure, said means for aligning formed in said second platform assembly facing downwardly into said open ended enclosure and communicating with said stacked photographic products thereby forming a closed ended package;

e. surroundingly strapping said first platform assembly upwardly around said closed ended package thereby forming a unitized package arrangement;

f. surroundingly strapping said carrying means upwardly around and to said unitized package arrangement;

g. circumferentially stretch wrapping said unitized package arrangement and said carrying means to protect said products from contamination;

h. transporting said unitized package arrangement to a conveyance means cooperating with a substantially contamination free environment;

i. unstrapping said carrying means from said unitized package arrangement;

j. removing said stretch wrapping from said unitized package arrangement and said carrying means thereby enabling said unitized package arrangement to be released from said carrying means;

k. releasing the sensitive photographic product handling device from said carrying means for conveyance of said sensitive photographic products into a substantially contamination free environment; and l. returning said carrying means to storage.

2. The method recited in claim 1 wherein said carrying means comprises a plurality of spaced support members defining feet, a base structurally attached to each of said support members and end support members structurally connected to an opposite side of said base from said feet, said end support members having opposed upwardly open channels formed in a top portion thereof for releaseably receiving said article handling device.

3. The method recited in claim 1 wherein said open ended enclosure is scored on opposite sides for collapsibly folding said sidewalls inwardly after use.

4. The method recited in claim 1 wherein said strapping step e. follows a path comprising through said notch in said first platform assembly, through said correspondingly aligned through holes of said opposed spaced runners and through said notch in the opposite side of said platform assembly.

5. The method in claim 1 wherein said strapping step f. follows a path comprising from the bottom of said carrying means between said feet, upwardly around said unitized package arrangement through said correspondingly aligned notches on said second platform assembly.

* * * * *